US007296492B2

(12) United States Patent
Marine et al.

(10) Patent No.: US 7,296,492 B2
(45) **Date of Patent: *Nov. 20, 2007**

(54) ANIMATED TOY WITH GENEVA MECHANISM

(75) Inventors: Jon C. Marine, Fullerton, CA (US); Ivan Chan, Hong Kong (HK); Sam Tsui, Hong Kong (HK)

(73) Assignee: Mattel, Inc., El Segundo, CA (US)

( * ) Notice: Subject to any disclaimer, the term of this patent is extended or adjusted under 35 U.S.C. 154(b) by 383 days.

This patent is subject to a terminal disclaimer.

(21) Appl. No.: 10/661,310

(22) Filed: Sep. 12, 2003

(65) Prior Publication Data

US 2004/0082264 A1 Apr. 29, 2004

Related U.S. Application Data

(63) Continuation of application No. 09/908,971, filed on Jul. 18, 2001, now Pat. No. 6,623,327.

(60) Provisional application No. 60/224,697, filed on Aug. 11, 2000.

(51) Int. Cl.
*F16H 55/17* (2006.01)
*F16H 55/06* (2006.01)

(52) U.S. Cl. ..... 74/435; 74/436; 74/437; 74/396

(58) Field of Classification Search ..... 446/330, 446/300, 302, 303, 298, 299, 335, 338, 353, 446/354, 365, 352, 376, 384, 391; 74/353, 74/354, 432, 435–7, 439, 89.2, 89.21, 89.22, 74/25, 37; 474/171

See application file for complete search history.

(56) References Cited

U.S. PATENT DOCUMENTS 3,298,130 A 1/1967 Ryan
3,583,093 A 6/1971 Glass et al.

(Continued)

FOREIGN PATENT DOCUMENTS

JP 60241110 A 11/1985

(Continued)

OTHER PUBLICATIONS

Selected pages from a book entitled "Machine Devices and Instrumentation", *Kinematics of Intermittent Mechanisms 1-The External Geneva Wheel and Kinematics of Intermittent Mechanisms II-The Internal Geneva Wheel*, Copyright 1966.

(Continued)

*Primary Examiner*—Monica Carter
*Assistant Examiner*—Pradeep Battula
(74) *Attorney, Agent, or Firm*—Kolisch Hartwell, P.C.

(57) ABSTRACT

An animated children's toy including a gear system for providing intermittent and reciprocal motion. The gear system includes a drive gear and a driven gear. The gear system is adapted to have a non-rotating configuration and an engaged configuration. In the non-rotating configuration the driven gear is prevented from rotating, and a corresponding portion of the animated children's toy is not moving. In the engaged configuration the driven gear rotates and a corresponding portion of the animated children's toy moves.

17 Claims, 5 Drawing Sheets

U.S. PATENT DOCUMENTS

| | | | |
|---|---|---|---|
| 3,650,065 | A | 3/1972 | Johmann |
| 3,672,096 | A | 6/1972 | Johmann |
| 3,846,934 | A | 11/1974 | Thorn et al. |
| 3,912,694 | A | 10/1975 | Chiappe et al. |
| 4,023,254 | A | 5/1977 | Aiple et al. |
| 4,073,088 | A | 2/1978 | Beny et al. |
| 4,177,602 | A | 12/1979 | Choi |
| 4,349,987 | A | 9/1982 | Bart |
| 4,516,951 | A | 5/1985 | Saigo et al. |
| 4,563,163 | A | 1/1986 | Herbstler et al. |
| 4,665,640 | A | 5/1987 | Forsse et al. |
| 4,681,993 | A | 7/1987 | Kondo et al. |
| 4,752,272 | A | 6/1988 | Karasawa |
| 4,764,141 | A | 8/1988 | D'Andrade |
| 4,775,352 | A | 10/1988 | Curran et al. |
| 4,819,229 | A | 4/1989 | Pritty et al. |
| 4,878,870 | A | 11/1989 | Pastor |
| 5,030,161 | A | 7/1991 | Pastor |
| 5,092,102 | A | 3/1992 | James et al. |
| 5,125,865 | A | 6/1992 | Orenstein et al. |
| 5,158,492 | A | 10/1992 | Rudell et al. |
| 5,224,896 | A | 7/1993 | Terzian |
| 5,236,385 | A | 8/1993 | May |
| 5,310,377 | A | 5/1994 | Joja |
| 5,316,516 | A | 5/1994 | Saitoh |
| 5,394,766 | A | 3/1995 | Johnson et al. |
| 5,405,142 | A | 4/1995 | Arad et al. |
| 5,505,652 | A | 4/1996 | Click |
| 5,647,787 | A | 7/1997 | Raviv et al. |
| 5,747,760 | A | 5/1998 | Skarivoda |
| 5,820,441 | A | 10/1998 | Pracas |
| 5,941,756 | A | 8/1999 | Chou |
| 6,547,632 | B2 * | 4/2003 | Marine et al. ..... 446/354 |
| 6,623,327 | B2 * | 9/2003 | Marine et al. ..... 446/330 |

FOREIGN PATENT DOCUMENTS

| | | | |
|---|---|---|---|
| JP | 2065887 | A | 3/1990 |
| JP | 3258282 | A | 11/1991 |
| JP | 5253866 | A | 10/1993 |
| WO | WO 01/49383 | A1 * | 7/2001 |

OTHER PUBLICATIONS

Herbert Herkiner, ed., *Engineers' Illustrated Thesaurus*, W. M. Pem Publishing, 1952, pp. 172-173.

Selected pages, Geneva 1 and 2 from book entitled "Mechanism Linkages and Mechanical Controls" author Nicholas Chironis, (c) 1965.

Selected pages from a book entitled "Mechanisms, Linkages, and Mechanical Controls." *Geneva Mechanims*, Copyright 1965.

Selected pages, Geneva 3, 4, 5, 6, 7 and 8 from book entitled "Mechanisms and Mechanical Devices 2nd Edition", authors Nicholas Chironis, Neil Sclater, (c) 1996,1991.

* cited by examiner

ANIMATED TOY WITH GENEVA MECHANISM

CROSS-REFERENCE TO RELATED APPLICATIONS

This application is a continuation of U.S. patent application Ser. No. 09/908,971, filed Jul. 18, 2001 now U.S. Pat. No. 6,623,327 and entitled "Animated Toy with Geneva Mechanism", which application is based upon and claims priority under 35 U.S.C. § 119(e) to U.S. Provisional Patent Application Ser. No. 60/224,697, filed Aug. 11, 2000 and entitled "Motorized Doll", which is incorporated herein by reference in its entirety for all purposes.

TECHNICAL FIELD

The present invention relates generally to animated toys, and more particularly to a toy including a Geneva mechanism providing for intermittent reciprocal motion of moveable parts of the toy.

BACKGROUND AND SUMMARY

In recent years animation in children's toys has become very popular. Animated toys include a system for generating motion, typically driven by small rotating motors that connect to gears, pulleys or levers. Some animation systems for animated toys include a Geneva mechanism designed to produce an intermittent motion, such as those shown in U.S. Pat. Nos. 4,764,141; 5,310,377; and 5,405,142, the disclosures of which are incorporated herein by reference.

The present invention relates to animated toys in which parts of the toy undergo intermittent reciprocal motion. This motion is driven by one or more motors, each interconnected to a skeletal structure of the toy through various gears, pulleys, and cables. At least one of the gears pulls on one of the cables to in turn pull on the portion of the skeletal structure that is to be moved, and that gear may cooperate with other gears to have an engaged position and one or more non-rotating positions, as may be found in a Geneva gear mechanism. When the gear is in the engaged position, a motor may rotate the gear to actuate a discrete motion of a part of the toy, and when the gear is in a non-rotating position, the gear may hold that part of the toy in a fixed position, even as other gears driven by the same motor actuate other motions within the toy. Combining a series of these gears, each producing different discrete motions, creates an animated toy capable of complex movements with a lesser number of motors.

This present invention will be more readily understood after a consideration of the drawings and the detailed description of the preferred embodiment.

DETAILED DESCRIPTION OF THE INVENTION

Figure 1:
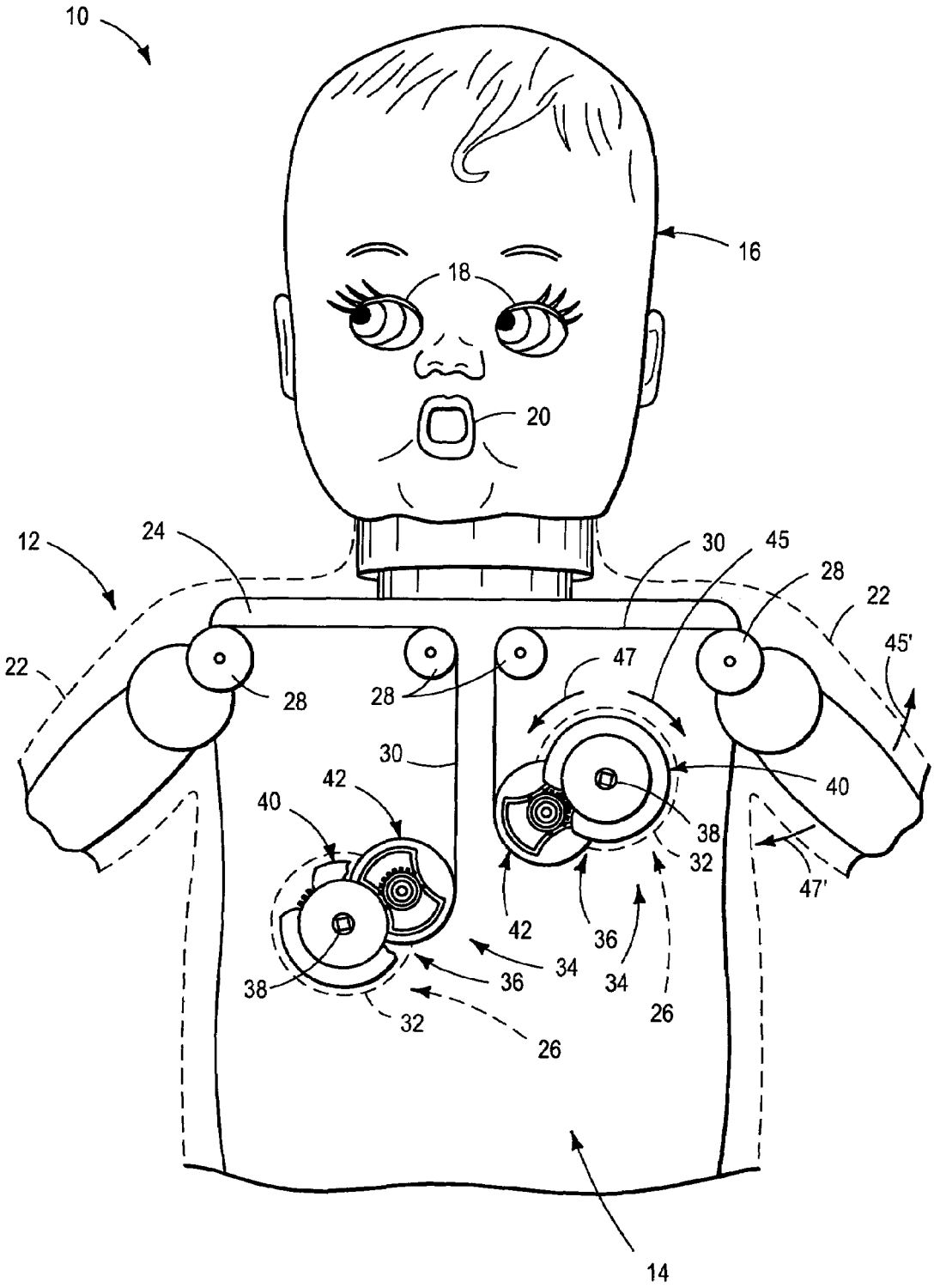
FIG. 1 is a schematic view of an animated toy according to one embodiment of the present invention, having a gear system for providing intermittent motion.

A children's toy according to the present invention is indicated generally at 10 in FIG. 1. Toy 10 may be a doll, or other figure resembling an animal or make believe creature. Toy 10 includes a body 12 and an animation mechanism 14. Animation mechanism 14 is adapted to move various parts of body 12.

Body 12 may include a head 16, eyes 18, a mouth 20, arms 22 and legs (not shown). Animation mechanism 14 includes a skeletal structure 24, a motor assembly 26, pulleys 28, and cables 30. As discussed below animation mechanism 14 provides toy 10 with motion, such as a turning of head 16 back and forth, an opening and closing of eyes 18 or mouth 20, and a back and forth movement of arms 22 or the legs.

Motor assembly 26 includes at least one motor 32, a gear assembly 34, and a battery pack (not shown). Gear assembly 34 includes at least one gear system 36, and may be adapted to attach to an output 38 of motor assembly 26 or be incorporated into motor assembly 26. Each motor 32 of motor assembly 26 is connected to at least one gear system 36. As motor 32 rotates, gear system 36 rotates, thereby actuating movements in toy 10.

Gear system 36 includes a drive gear 40 and a driven gear 42. Motor 32 is adapted to rotate both clockwise and counterclockwise and configured to induce the same clockwise and counterclockwise rotation in drive gear 40. Drive gear 40 is adapted to selectively impart rotation in driven gear 42. Rotation of driven gear 42, being connected to cable 30 of animation mechanism 14, induces motion in a selected part of the toy's body 12.

It should be understood that motor assembly 26 and gear systems 36 are shown schematically and motor assembly 26 can include a plurality of motors 32. Each motor 32 may be adapted to drive a plurality of stacked drive gears 40, positioned such that drive gears 40 actuate a corresponding plurality of driven gears 42 located at discrete angular positions along the path of rotation of the stack of drive gears 40. Each of driven gears 42 is adapted to actuate a discrete reciprocal movement within a selected part of the toy's body 12.

When drive gear 40 sweeps through the angular location associated with a particular movement of toy 10, drive gear 40 intermeshes with driven gear 42 causing cable 30 to move, thereby actuating motion in a part of toy 10. These movements include, but are not limited to, rotation of the toy's head 16, opening and closing of the toy's eyes 18, movement of the toy's mouth 20, back and forth motion of arms 22 and corresponding back and forth motion of the legs. While cables 30 are shown schematically linking skeletal structure 24 to gear system 36 it should be understood that any suitable linkage structure could be used including belts, chains, rods, etc.

Gear system 36 produces an intermittent motion similar to the Geneva mechanisms that are known in the art. Gear system 36 has two configurations, an engaged configuration and a non-rotating configuration. In the engaged configuration, drive gear 40 is intermeshed with driven gear 42 and rotation of drive gear 40 causes rotation in driven gear 42. In the non-rotating configuration drive gear 40 slidingly engages driven gear 42 such that rotation of drive gear 40, not only does not cause rotation in driven gear 42, but also prevents the driven gear from rotating.

In the present embodiment of gear system 36 drive gear 40 and driven gear 42 are made of a plastic material. It should be understood that any suitable material may be used to form the gears of gear system 36 including metal alloys, polymers, ceramics, and composites of these materials depending upon the load characteristics of the particular application.

Gear system 36 in the engaged configuration rotates in a first direction 50 and a second direction 52. When drive gear 40 rotates in first direction 50, driven gear 42 rotates in response causing cable 30 to move arm 22 in the direction indicated at 50'. Correspondingly, when drive gear 40 rotates in a second direction 52, driven gear 42 causes cable 30 to move arm 22 in the opposite direction 52'. Thus, in the engaged configuration, gear system 36 is adapted to move a corresponding body part, in this case arm 22, in either a first direction 50' or an opposed second direction 52'. By contrast, when the gear system is in the non-rotating configuration the corresponding body part is at rest or not moving.

In the non-rotating configuration, drive gear 40 slidingly contacts driven gear 42. Thus, rotation of drive gear 40 in either direction while gear system 36 is in the non-rotating configuration induces no motion in driven gear 42. Because driven gear 42 is not moving it does not cause motion in any of the body parts of toy 10. Additionally, in the non-rotating configuration the driven gear is prevented from rotating by the sliding contact between drive gear 40 and driven gear 42.

Figure 2:
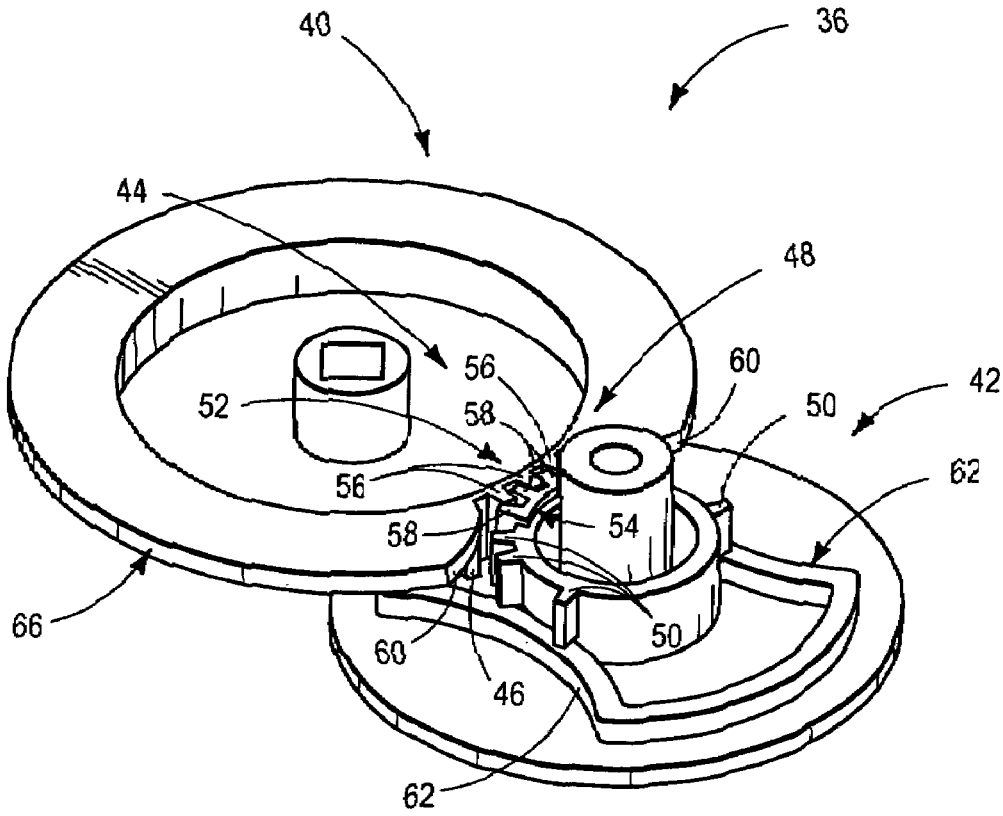
FIG. 2 is an isometric view of the gear system of FIG. 1.

FIG. 2 illustrates the operation of an embodiment of gear system 36, shown in the engaged configuration. Drive gear 40 and driven gear 42 are adapted to rotate with respect to one another in this configuration. Drive gear 40 includes a drive cam structure 44 and drive gear teeth 46. Driven gear 42 includes a driven cam structure 48 and driven teeth 50. Drive cam structure 44 is adapted to cooperate with driven cam structure 48 and interacts to selectively control the configuration of gear system 36.

Drive cam structure 44 includes a cam recess region 52, which is adapted to cooperate with a cam lobe portion 54 of driven cam structure 48. Drive cam structure 44 further includes extended drive teeth 56, which are formed from a portion of the set of drive teeth 46 positioned along a portion of the nominal perimeter of drive gear 40 located within cam recess region 52. Cam lobe portion 54 may include cam lobe teeth 58, which are formed from a portion of the set of driven teeth 50 that extend axially further than the rest of the set of drive teeth 46.

Cam lobe teeth 58 are designed to engage corresponding extended drive teeth 56. This axially extended engagement between the extended drive teeth 56 and cam lobe teeth 58 forms additional bearing contact between drive gear 40 and driven gear 42 which helps to keep gears 40 and 42 in alignment under loading. Cam recess region 52 includes alignment guide surfaces 60, which are adapted to interact with cam lobe portion 54 and align driven teeth 50 with drive teeth 46. Alignment guide surfaces 60 also align extended drive teeth 56 with cam lobe teeth 58 as gear system 36 transitions between the engaged configuration and the non-rotating configuration.

Driven cam structure 48 further includes bearing surface regions 62 and drive cam structure 44 further includes a drive cam bearing surface 64 also referred to as sliding surface 64. Driven gear 42 is prevented from rotating in either of the non-rotating configurations, when drive cam bearing surface 64 contacts either of driven cam bearing surface regions 62.

Figure 3:
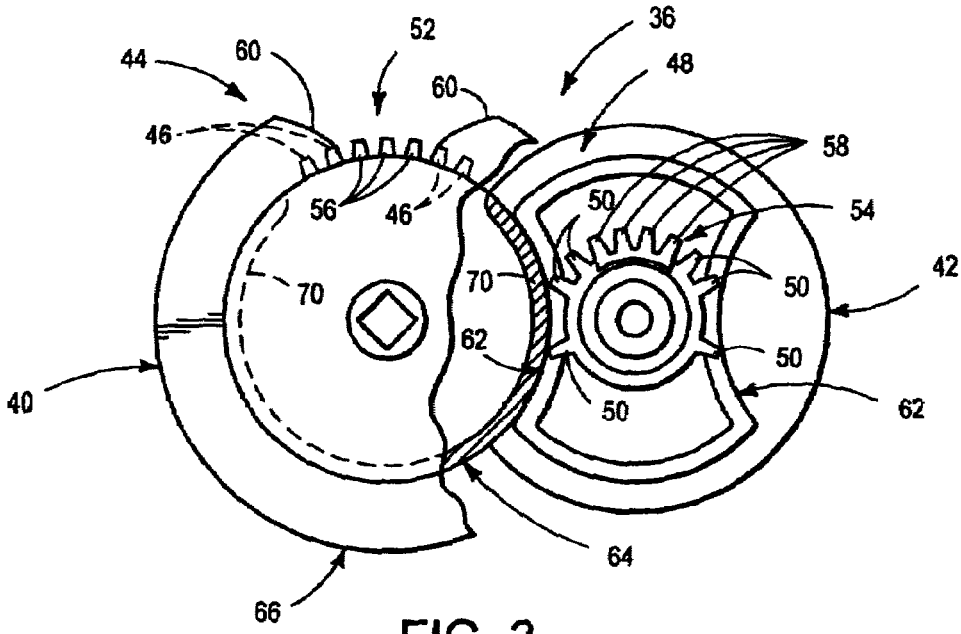
FIG. 3 is a partially cut away top view of the gear system of FIG. 2.

Turning to FIG. 3, drive gear 40 and driven gear 42 of gear system 36 are shown in the non-rotating configuration. Gear system 36 may have more than one non-rotating configuration. In any of the non-rotating configurations the sliding engagement of drive cam structure 44 with driven cam structure 48 prevents driven gear 42 from rotating. That is to say that drive gear 40 rotates and driven gear 42 remains stationary. Drive cam bearing surface 64 and a perimeter flange 66 of drive cam bearing structure 44 are shown in FIG. 3.

Figure 4:
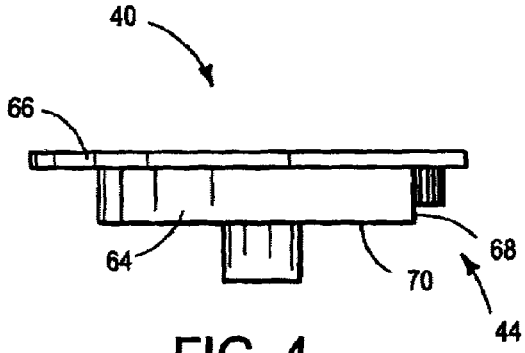
FIG. 4 is a side view of a drive gear of the gear system of FIG. 3.
Figure 6:
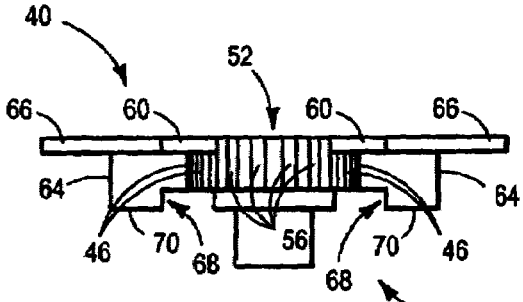
FIG. 6 is a side view of the drive gear of the gear system of FIG. 2, rotated 90° from the side view shown in FIG. 4.

Alignment guide surfaces 60 and the set of extended drive teeth 56, which are longer axially than the remaining drive teeth 46, are shown in more detail in FIG. 3. Alignment guide surface 60 guides cam lobe portion 54 into notch 52. Cam lobe teeth 58 engage extended drive teeth 56 as cam lobe portion 54 enters notch 52. Drive cam bearing surface 64 includes a surface extension region 68, best illustrated in FIGS. 4 and 6, which is configured to increase the available surface area for contact between drive gear 40 and driven gear 42 while gear system 36 is in a non-rotating configuration. An arcuate shaped perimeter rim 70, shown dashed in FIG. 3, forms a portion of the surface extension region 68 and extends axially from the edge of drive cam bearing surface 64, providing still more surface area to help maintain alignment in gear system 36.

Drive cam bearing surface 64 slides along driven cam-bearing surface region 62 at a contact area defined by the area of the overlapping surfaces. Arcuate perimeter rim 70 increases the contact area between drive cam bearing surface 64 and corresponding bearing surface region 62 located on driven cam structure 48 of driven gear 42. The increased contact area between drive gear 40 and driven gear 42 improves the alignment of the two gears and helps prevent binding. The interaction of drive cam bearing surface 64 and driven cam-bearing surface regions 62 aid in maintaining alignment of drive gear 40 and driven gear 42, preventing driven gear 42 from rotating when drive cam bearing surface 64 is in contact with either of driven cam-bearing surface regions 62.

Figure 5:
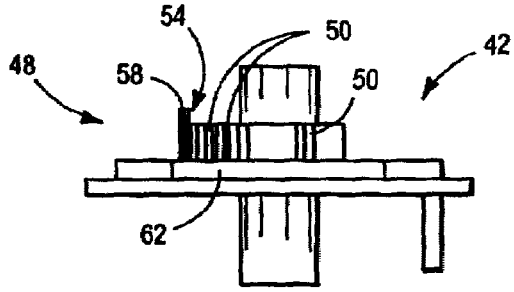
FIG. 5 is a side view of a driven gear of the gear system of FIG. 2.
Figure 7:
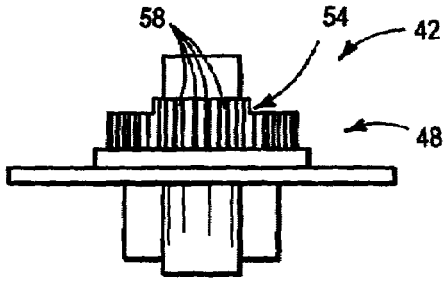
FIG. 7 is a side view of the driven gear of the gear system of FIG. 2, rotated 90° from the side view shown in FIG. 5.

As discussed above in addition to bearing surface regions 62, drive cam structure 44 includes cam lobe portion 54 adapted to interact with cam recess region 52. Bearing surface regions 62 interact with drive cam bearing surface 64 when gear system 36 is in any of the non-rotating configurations. As previously discussed, cam lobe portion 54 of driven cam structure 48 may include cam lobe teeth 58. Cam lobe teeth 58 are formed from a portion of the set of driven teeth 50, which extend axially farther than the remaining driven teeth 50 of the set, best illustrated in FIGS. 5 and 7.

Drive gear 40 rotates through a maximum predetermined angular sweep before reversing direction. Drive gear 40 should not rotate beyond a maximum amount of 360 degrees, before reversing the direction of rotation. Drive gear 40 may rotate less than 360 degrees before reversing direction, as desired. The maximum amount of rotation prevents drive teeth 46 from binding against driven gear 42 and possibly damaging gear system 36 from over rotation.

When gear system 36 is in either of the non-rotation configurations, drive gear 40 can be rotating toward engagement with driven gear 42 or away from engagement with driven gear 42. As drive gear 40 rotates toward engagement with driven gear 42, first, drive teeth 46 move into contact with driven teeth 50. Then cam lobe portion 54 slides along alignment guide surface 60 aligning cam lobe teeth 58 with extended drive teeth portion 56 of cam recess notch 52. As the drive teeth 46 engage the driven teeth 50, and cam lobe teeth 54 engage drive teeth portion 56, counter rotation between drive gear 40 and driven gear 42 occurs.

Drive teeth 46 are adapted to impart a predetermined amount of angular rotation to driven gear 42. The maximum amount of angular rotation of driven gear 42 may be 180 degrees.

The rotation of driven gear 42 actuates movement in a part of toy 10, by pulling cable 30, which is attached to a portion of skeletal structure 24, around rotating pulley 28 to move a part of body 12. The movement of cable 30 exerts a force on the portion of skeletal structure 24 that causes the portion of the body of toy 10 supported by that portion of skeletal structure 24 to move.

Alternatively, gear system 36 can be described as twin interengaged, motion coupled, rotors 40, 42. Twin rotors 40 and 42 are operatively mounted for juxtaposed intermittent rotation. Each rotor 40 and 42 includes a toothed region 46, 50, which lies along an arc that is less than a full circle, and each rotor 40 and 42 includes a sliding surface region 62, 64, which includes a portion that lies substantially outside the arc toothed region.

Rotors 40 and 42 are operatively positioned relative to one another in a manner, which enables two different characters of interengaged relative rotation motion. The first character involves toothed region to toothed region driving interengagement, wherein the twin rotors counter rotate relative to one another with a first rotor driving the other rotor. The first character of interengaged relative rotation motion occurs at a predefined sweep of angular orientation between twin rotors 40 and 42.

The second character involving sliding surface to sliding surface non-driving interengagement, wherein the first rotor rotates and the other rotor is stationary. The second character of interengaged relative rotation motion is achieved at two different angular orientation of the second or other rotor. The two angular orientations of the second rotor are spaced apart on either side of the angular sweep that is predefined for the first character of interengaged relative rotation motion.

The toothed regions of the rotors include portions that extend axially across a common plane, which is spaced generally normal to the axial direction.

Figure 8:
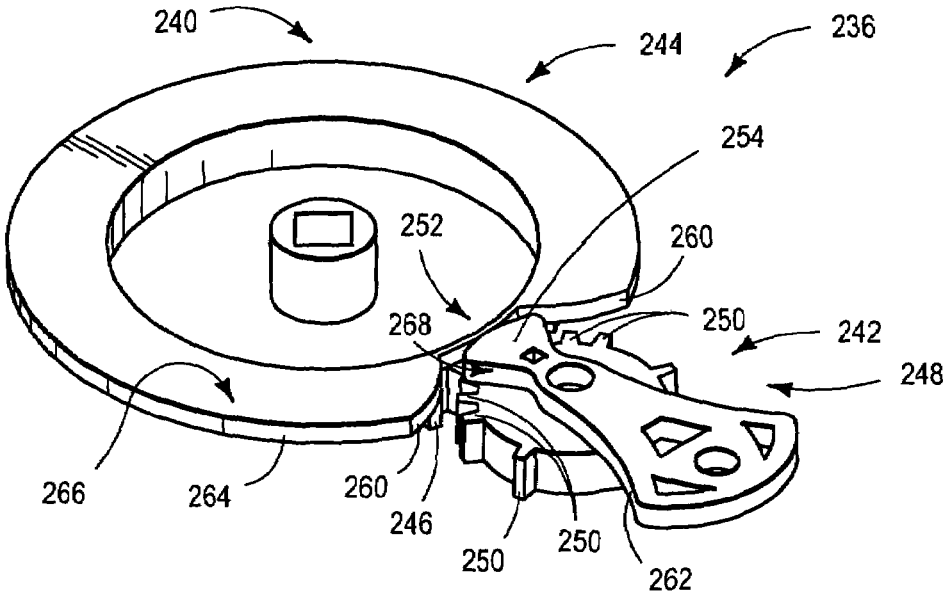
FIG. 8 is an isometric view of another embodiment of the gear system of FIG. 1.
Figure 9:
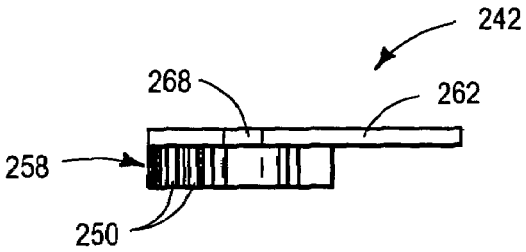
FIG. 9 is a side view of the driven gear of the gear system of FIG. 8.
Figure 10:
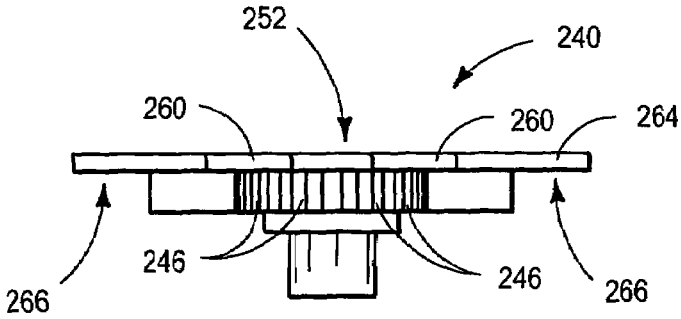
FIG. 10 is a side view of the drive gear of the gear system of FIG. 8.

Turning to FIG. 8, an alternative embodiment of the gear system is shown, generally indicated at 236. Gear system 236 includes a drive gear 240 and a driven gear 242. Drive gear 240 includes drive teeth 246 and a drive cam structure 244. Driven gear 242 includes driven teeth 250 and a driven cam structure 248. Drive cam structure 244 includes a cam recess region 252, alignment guide surfaces 260, a drive cam bearing surface 264 and a perimeter flange 266. Driven cam structure 248 includes driven cam bearing surface regions 262, and a cam lobe portion 254. Driven cam bearing surfaces 262 each incorporate a guide surface notch 268. Cam lobe portion 254 includes cam lobe teeth 258 adapted to engage corresponding drive teeth 246 of drive gear 240. The operational characteristics of this embodiment of the present invention are similar to that previously described.

Figure 11:
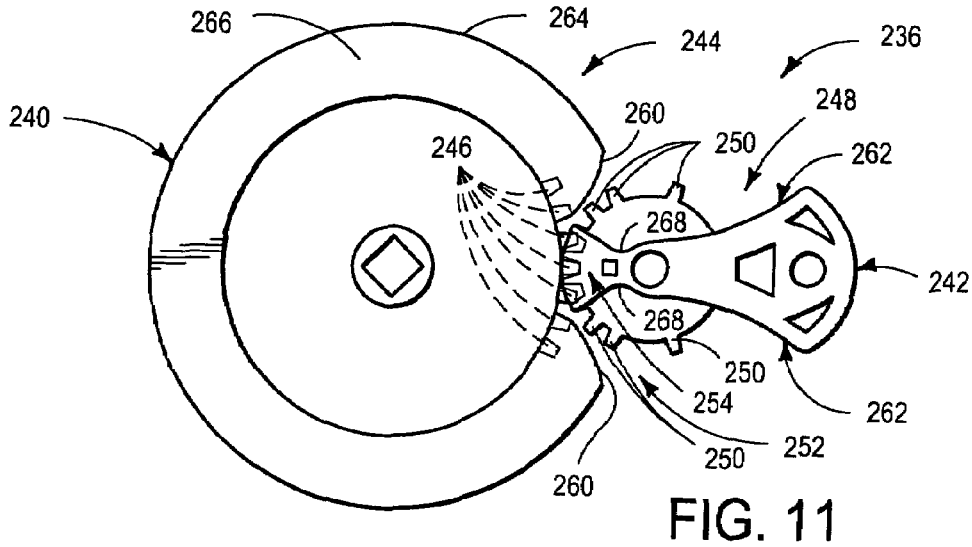
FIG. 11 is a top view of the gear system of FIG. 8, in an engaged configuration.
Figure 12:
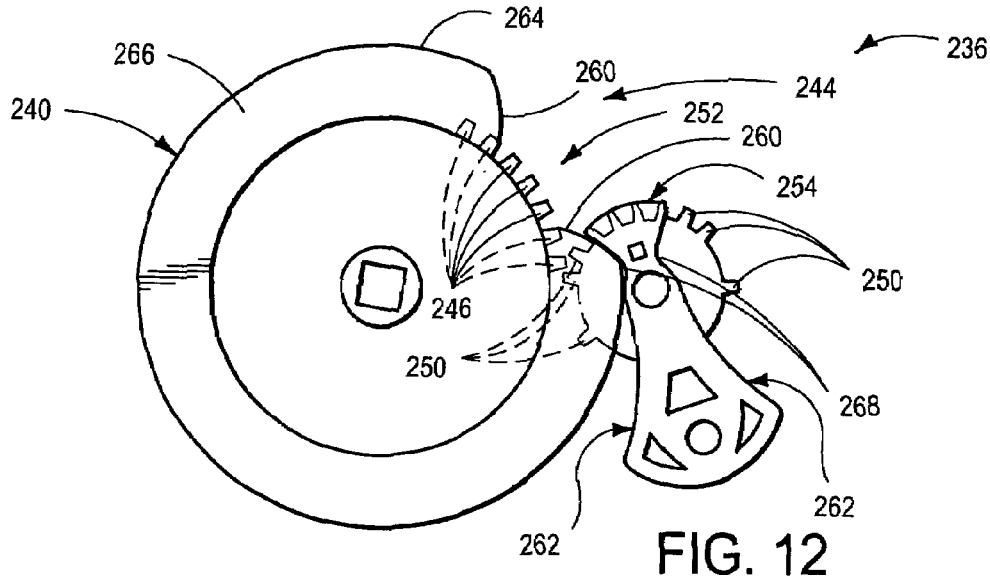
FIG. 12 is a top view of the gear system of FIG. 8, transitioning from an engaged configuration, to a non-rotating configuration.
Figure 13:
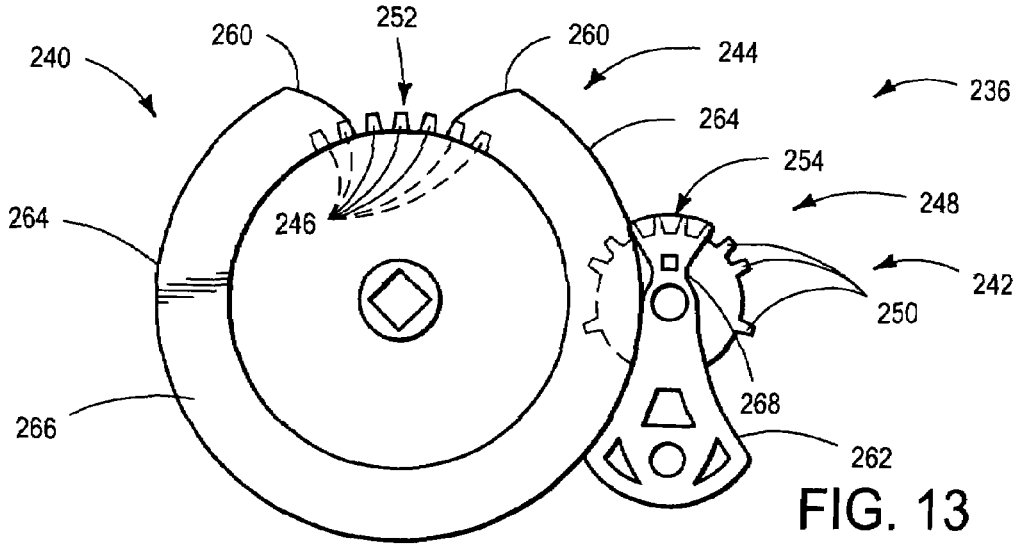
FIG. 13 is a top view of the gear system of FIG. 8, in a non-rotating configuration.

Referring to FIGS. 11 through 13, operational movement of gear structure 236 is shown. First in the engaged configuration in FIG. 11, then transitioning between the engaged configuration and one of the non-rotating configurations in FIG. 12, and finally, in one of the non-rotating configurations in FIG. 13. It should be understood that rotation in the opposite direction would place gear system 236 in the other non-rotating configuration, in which driven gear 242 is substantially 180 degrees rotated from the position shown in FIG. 13.

In the engaged configuration, cam lobe 254 is interacting with cam recess region 252 and cam lobe teeth 258 are intermeshing with drive teeth 246 causing driven gear 242 to counter rotate from drive gear 240 and actuating a discrete motion in a portion of toy 10 by moving cable 30 that connects to and actuates a portion of skeletal structure 24 that supports that portion of toy 10. In this engaged configuration, a reversal of direction of drive gear 240 will change the direction of motion of the moving portion of toy 10. Thus, the reciprocal motion is achieved by a change in the direction of rotation of drive gear 10.

As drive gear 240 continues to rotate, alignment guide surfaces 260 engage guide surface notch 268 and driven gear 242 begins to disengage from drive gear 240 as illustrated in FIG. 12. In this configuration, a reversal of direction of the drive gear will begin to reengage drive gear 240 and driven gear 242. The direction of motion of the moving portion of toy 10 will reverse direction. In this transitional state the corresponding motion that is being induced in a portion of toy 10 is approaching it's final, or extreme position. By final or extreme position it is meant that the portion of toy 10 will not move farther in the direction of motion caused by the gear system 236 causing the motion. Reversing the direction of rotation of gear system 236 will cause that portion of toy 10 to begin to move in an opposed direction.

Finally, as drive gear bearing surface 264 engages one of driven gear bearing surface regions 262, driven gear 242 is prevented from rotating by the sliding engagement of drive gear bearing surface 264 and driven gear bearing surface region 262, as shown in FIG. 13. In this configuration a reversal in direction of drive gear 240 will have no effect on driven gear 242 until, as shown in FIG. 12, cam lobe portion 254 starts to engage aligning surface 260 and drive teeth 246 start to engage driven teeth 250 and gear system 236 begins the transition between one of the non-rotation configurations and the engaged configuration.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. Where claims recite "a" or "a first" element or equivalent thereof, such claims should be understood to include incorporation of one or more such elements, neither requiring, nor excluding two or more such elements.

It is believed that the following claims particularly point out certain combinations and sub-combinations that are directed to one of the disclosed inventions and are novel and non-obvious. Inventions embodied in other combinations and sub-combinations of features, functions, elements and/ or properties may be claimed through amendment of those claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A Geneva mechanism for providing intermittent motion, comprising:

a drive gear adapted to receive rotational input, the drive gear having a drive cam structure and a set of drive teeth, the drive cam structure including a cam recess region-and a drive cam-bearing surface; and a driven gear having a driven cam structure and a set of driven teeth, wherein the driven cam structure includes at least two bearing surface regions and a cam lobe portion;

wherein the driven cam structure is adapted to engage the drive cam structure and align the set of drive teeth with the set of driven teeth to position the set of drive teeth to engage the set of driven teeth for selective transmission of the rotational input; wherein the driven gear has an engaged configuration, in which the driven teeth engage the drive teeth to cause the driven gear to counter rotate relative to the drive gear, and further wherein the driven gear has at least two non-rotating configurations, in which the drive cam structure and the driven cam structure are adapted to prevent the driven gear from rotating;

wherein, when the gear system is in the engaged configuration, the cam lobe portion engages the cam recess region and aligns the drive teeth and the driven teeth for rotational engagement, and further wherein, when the gear system is in either of the non-rotating configurations, one of the bearing surface regions slides along the drive cam-bearing surface forming a contact area as the drive gear rotates, preventing the driven gear from rotating; and wherein the cam recess region includes alignment guide surfaces adapted to guide the cam lobe portion into the cam recess and align the drive teeth and the driven teeth for engagement, and further wherein the cam recess region includes extended drive teeth formed by a portion of the set of drive teeth, which are longer axially than a remaining portion of drive teeth of the set.

2. A Geneva mechanism for providing intermittent motion, comprising:

a drive gear adapted to receive rotational input, the drive gear having a drive cam structure and a set of drive teeth, the drive cam structure including a cam recess region-and a drive cam-bearing surface; and a driven gear having a driven cam structure and a set of driven teeth, wherein the driven cam structure includes at least two bearing surface regions and a cam lobe portion;

wherein the driven cam structure is adapted to engage the drive cam structure and align the set of drive teeth with the set of driven teeth to position the set of drive teeth to engage the set of driven teeth for selective transmission of the rotational input; wherein the driven gear has an engaged configuration, in which the driven teeth engage the drive teeth to cause the driven gear to counter rotate relative to the drive gear, and further wherein the driven gear has at least two non-rotating configurations, in which the drive cam structure and the driven cam structure are adapted to prevent the driven gear from rotating;

wherein, when the gear system is in the engaged configuration, the cam lobe portion engages the cam recess region and aligns the drive teeth and the driven teeth for rotational engagement, and further wherein, when the gear system is in either of the non-rotating configurations, one of the bearing surface regions slides along the drive cam-bearing surface forming a contact area as the drive gear rotates, preventing the driven gear from rotating; and wherein the cam lobe portion includes a set of cam lobe teeth formed from a portion of the set of driven teeth, which extend axially from a remaining portion of driven teeth of the set.

3. A gear system for providing intermittent motion, comprising:

a drive gear adapted to receive rotational input, the drive gear having a drive cam structure and a set of drive teeth including a portion of extended drive teeth which are longer axially than a remaining portion of teeth of the set; and a driven gear having a driven cam structure and a set of driven teeth; wherein the driven gear and the drive gear are operatively associated for selective transmission of the rotational input; wherein the driven gear has an engaged orientation, in which the drive teeth engage the driven teeth to cause the driven gear to counter rotate relative to the drive gear; and further wherein the driven gear has at least two non-rotating orientations, in which the drive cam structure and the driven cam structure are adapted to prevent the driven gear from rotating.

4. The gear system of claim 3, wherein the drive cam structure includes a cam recess region and a drive cam-bearing surface, and wherein the driven cam structure includes at least two bearing surface regions and a cam lobe portion, wherein when the gear system is in the engaged orientation the cam lobe portion engages the cam recess region and aligns the drive teeth and the driven teeth for rotational engagement, and further wherein when the gear system is in either of the non-rotating orientations one of the bearing surface regions slides along the drive cam-bearing surface forming a contact area as the drive gear rotates, preventing the driven gear from rotating.

5. The gear system of claim 4, wherein the cam recess region includes alignment guide surfaces adapted to guide the cam lobe portion into the cam recess region and align the drive teeth and the driven teeth for engagement.

6. The gear system of claim 5, wherein the cam recess region includes the extended drive teeth formed by a portion of the set of drive teeth, which are longer axially than a remaining portion of drive teeth of the set.

7. The gear system of claim 4, wherein the drive cam-bearing surface includes a surface extension region adapted to increase the contact area between the drive cam-bearing surface and one of the bearing surface regions.

8. The gear system of claim 7, wherein the surface extension region is an axially upstanding arcuate perimeter rim.

9. The gear system of claim 4, wherein the cam lobe portion includes a set of cam lobe teeth formed from a portion of the set of driven teeth, which extend axially from a remaining portion of driven teeth of the set.

10. The gear system of claim 4, wherein the drive cam structure includes a perimeter flange adapted to axially align the drive gear and the driven gear.

11. The gear system of claim 10, wherein the perimeter flange includes the drive cam-bearing surface.

12. The gear system of claim 11, wherein the cam lobe portion is adapted to slidingly engage the drive cam-bearing surface on the perimeter flange when the gear system is in either of the non-rotating orientations.

13. The gear system of claim 4, further comprising an axial alignment structure attached to at least one of the drive gear and driven gear and configured to extend at least partially over the other of the drive gear and driven gear.

14. The gear system of claim 13, wherein the axial alignment structure includes a disk.

15. The gear system of claim 4, wherein at least one of the drive gear and driven gear is plastic.

16. A gear system for providing intermittent motion, the system comprising:

a drive gear having a set of drive teeth including a portion of extended drive teeth that are longer axially than a remaining portion of teeth of the set, and a means to selectively engage a set of driven teeth on a corresponding driven gear;

a driven gear having a set of driven teeth and a means to align the set of driven teeth with the set of drive teeth of the drive gear; and at least two rotation locking means for preventing the driven gear from rotating in response to a rotation of the drive gear.

17. A gear system for providing intermittent motion, comprising:

a drive gear adapted to receive rotational input, the drive gear having a drive cam structure and a set of drive teeth, the drive cam structure including a cam recess region that includes a bearing surface; and a driven gear having a driven cam structure and a set of driven teeth, the driven cam structure including a cam lobe portion that includes a bearing surface configured to engage the cam recess bearing surface upon engagement of the drive teeth and the driven teeth; wherein the driven gear and the drive gear are operatively associated for selective transmission of the rotational input; wherein the driven gear has an engaged orientation, in which the drive teeth engage the driven teeth to cause the driven gear to counter rotate relative to the drive gear, and further wherein the driven gear has at least two non-rotating orientations, in which the drive cam structure and the driven cam structure are adapted to prevent the driven gear from rotating, wherein the cam lobe portion includes a set of cam lobe teeth formed from a portion of the set of driven teeth, which extend axially from a remaining portion of driven teeth of the set.

* * * * *